US007116047B2

(12) United States Patent
Kim et al.

(10) Patent No.: US 7,116,047 B2
(45) Date of Patent: Oct. 3, 2006

(54) PLASMA DISPLAY PANEL (PDP) HAVING ADDRESS ELECTRODES WITH DIFFERENT THICKNESSES

(75) Inventors: Gi-young Kim, Chungji-si (KR); Young-mo Kim, Suwon-si (KR); Hyoung-bin Park, Seongnom-si (KR); Sang-hun Jang, Youngin-si (KR); Seung-hyun Son, Gyeonggi-do (KR); Hidekazu Hatanaka, Seongnam-si (KR); Ji-hyun Hong, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 77 days.

(21) Appl. No.: 10/848,136

(22) Filed: May 19, 2004

(65) Prior Publication Data

US 2004/0232843 A1 Nov. 25, 2004

(30) Foreign Application Priority Data

May 21, 2003 (KR) ..... 10-2003-0032256

(51) Int. Cl.
*H01J 17/49* (2006.01)

(52) U.S. Cl. ..... 313/584; 313/582

(58) Field of Classification Search ..... 313/582–587; 345/37, 41, 60, 71; 315/169.4
See application file for complete search history.

(56) References Cited

U.S. PATENT DOCUMENTS 5,541,618 A 7/1996 Shinoda (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
*Assistant Examiner*—Bumsuk Won
(74) *Attorney, Agent, or Firm*—Robert E. Bushnell, Esq.

(57) ABSTRACT

In an Alternating Current (AC) plasma display panel, a rear substrate and a front substrate are arranged to face each other. Discharge cells are formed between the rear and front substrates. A plurality of strip-shaped address electrodes are arranged on the rear substrate. A first dielectric layer is arranged on the rear substrate, and the address electrodes are buried in the first dielectric layer. A plurality of strip-shaped sustaining electrodes are arranged in pairs on the rear substrate to cross the address electrodes at right angles. A second dielectric layer is arranged on the rear substrate, and the sustaining electrodes are buried in the second dielectric layer. A protective layer is arranged on a bottom surface of the second dielectric layer. A plurality of barrier ribs are arranged between the front and rear substrates and define the discharge cells. The lateral sides of each of the barrier ribs are coated with a fluorescent layer. Each of the address electrodes includes thick portions disposed below the discharge cells and thin portions disposed between adjacent thick portions. The thick portions are thicker than the thin portions.

16 Claims, 13 Drawing Sheets

U.S. PATENT DOCUMENTS

| | | | |
|---|---|---|---|
| 5,661,500 | A | 8/1997 | Shinoda et al. |
| 5,663,741 | A | 9/1997 | Kanazawa |
| 5,674,553 | A | 10/1997 | Shinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B1 | 3/2004 | Setoguchi et al. |
| 6,794,820 | B1 * | 9/2004 | Kang et al. ..... 313/586 |
| 6,853,136 | B1 * | 2/2005 | Kim et al. ..... 313/582 |
| 2004/0027070 | A1 * | 2/2004 | Yasui et al. ..... 313/582 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY PANEL (PDP) HAVING ADDRESS ELECTRODES WITH DIFFERENT THICKNESSES

CLAIM OF PRIORITY

This application makes reference to, incorporates the same herein, and claims all benefits accruing under 35 U.S.C. § 119 from an application for ALTERNATING CURRENT (AC) TYPE PLASMA DISPLAY PANEL AND METHOD OF FORMING ADDRESS ELECTRODE earlier filed in the Korean Intellectual Property Office on May 21, 2003 and there duly assigned Serial No. 2003-32256.

BACKGROUND OF THE INVENTION

1. Field of the Invention

The present invention relates to an Alternating Current (AC) Plasma Display Panel (PDP), and more particularly, to an AC PDP having address electrodes that are shaped so that the luminous efficiency can be increased without increases in a driving voltage and the discharge delay time, and a method of forming the address electrodes on a rear substrate of the AC PDP.

2. Description of the Related Art

PDPs, which form an image using an electrical discharge, provide excellent display characteristics, such as luminance or a viewing angle, and accordingly, their use is increasing. In PDPs, a direct voltage or an alternating voltage is applied to electrodes and causes a discharge to occur in gas arranged between the electrodes. Ultraviolet rays are radiated during the gas discharge to cause an excitation of phosphors. The excited phosphors radiate visible rays.

PDPs can be classified as Direct Current (DC) PDPs or Alternating Current (AC) PDPs according to the type of discharging. DC PDPs include electrodes that are all exposed to a discharge space. In the DC PDPs, electrical charges directly move from one electrode to an opposite electrode. In the AC PDPs, at least one of electrodes is covered with a dielectric layer, and discharge occurs by wall charges and not by direct movement of electrical charges between opposite electrodes.

PDPs can also be classified as opposite discharge PDPs or surface discharge PDPs according to the arrangement of electrodes. In opposite discharge PDPs, one of a pair of sustaining electrodes is formed on a front substrate and the other sustaining electrode is formed on a rear substrate, and discharge occurs in the vertical axial direction. In surface discharge PDPs, a pair of sustaining electrodes is formed on the same substrate, and discharge occurs on one plane of the substrate.

The opposite discharge PDPs provide high luminous efficiency but have drawbacks in that a fluorescent layer is easily deteriorated by the plasma and in that a high voltage is required for discharge. Hence, surface discharge PDPs are widely used of late.

SUMMARY OF THE INVENTION

The present invention provides an alternating current (AC) plasma display panel (PDP) in which address electrodes are shaped so that a driving voltage is not increased even when the heights of barrier ribs increase, thereby increasing luminous efficiency.

The present invention also provides a method of forming the address electrodes of the AC PDP on a rear substrate.

According to an aspect of the present invention, a plasma display panel is provided including a rear substrate and a front substrate, a plurality of strip-shaped address electrodes, first and second dielectric layers, a plurality of strip-shaped sustaining electrodes, a protective layer, and a plurality of barrier ribs. The rear substrate and the front substrate are arranged to face each other and discharge cells are arranged therebetween. The address electrodes are arranged on the rear substrate. The first dielectric layer is arranged on the rear substrate, and the address electrodes are buried in the first dielectric layer. The sustaining electrodes are arranged in pairs on the rear substrate to cross the address electrodes at right angles. The second dielectric layer is formed on the rear substrate, and the sustaining electrodes are buried in the second dielectric layer. The protective layer is formed on a bottom surface of the second dielectric layer. The barrier ribs are arranged between the front and rear substrates and define the discharge cells, and have lateral sides coated with a fluorescent layer. Each of the address electrodes includes thick portions arranged below the discharge cells and thin portions arranged between adjacent thick portions. The thick portions are thicker than the thin portions.

According to an aspect of the present invention, each of the thick portions of the address electrodes has a thickness of between 5 to 7 μm.

According to an aspect of the present invention, the thick portions of the address electrodes are between 10 to 30 μm thicker than the thin portions. In this case, the height of each of the barrier ribs is in the range of 130 to 160 μm.

More preferably, the thick portions of the address electrodes are 20 μm thicker than the thin portions. In this case, the height of each of the barrier ribs is preferably 140 μm.

According to an aspect of the present invention, the widths of the thick portions are equal to or greater than those of the thin portions.

According to another aspect of the present invention, a method of forming address electrodes is provided, in each of which thick and thin portions are alternately arranged on a rear substrate of a plasma display panel. In this method, a first screen mask having strip-shaped first openings arranged on the rear substrate. First metal layers are formed by printing metallic paste on the rear substrate using the first screen mask. The first metal layers are dried. A second screen mask having second openings formed at locations corresponding to the thick portions is arranged on the rear substrate. Second metal layers are formed by printing metallic paste on the first metal layers using the second screen mask. The second metal layers are dried, and the first and second metal layers are plasticized.

The first screen mask is preferably a #325 mesh net, and the first metal layers are preferably formed to a thickness of 10 μm in the first metal layer forming step, and the second screen mask is preferably a #80–#100 mesh net.

According to another aspect of the present invention, a method of forming address electrodes is also provided, in each of which thick and thin portions are alternately arranged on a rear substrate of a plasma display panel. In this method, a screen mask is arranged on the rear substrate. The screen mask has first openings formed at locations corresponding to the thin portions and second openings formed at locations corresponding to the thick portions. Metal layers are formed by printing metallic paste on the rear substrate using the screen mask. The metal layers are dried and plasticized.

An area of the screen mask where the first openings are formed is preferably a #325 mesh net, and an area of the screen mask where the second openings are formed is preferably a #80–#100 mesh net.

In the two aforementioned methods, the second openings are formed to be wider than the first openings so that the thick portions have widths greater than the thin portions.

The metal paste is preferably one of Ag, Au, and Cu.

According to the present invention as described above, luminous efficiency is increased with an increase in the height of each of the barrier ribs. Even when the barrier ribs become higher, the interval between the address electrodes and the sustaining electrodes does not increase, and consequently, an address voltage does not increase.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
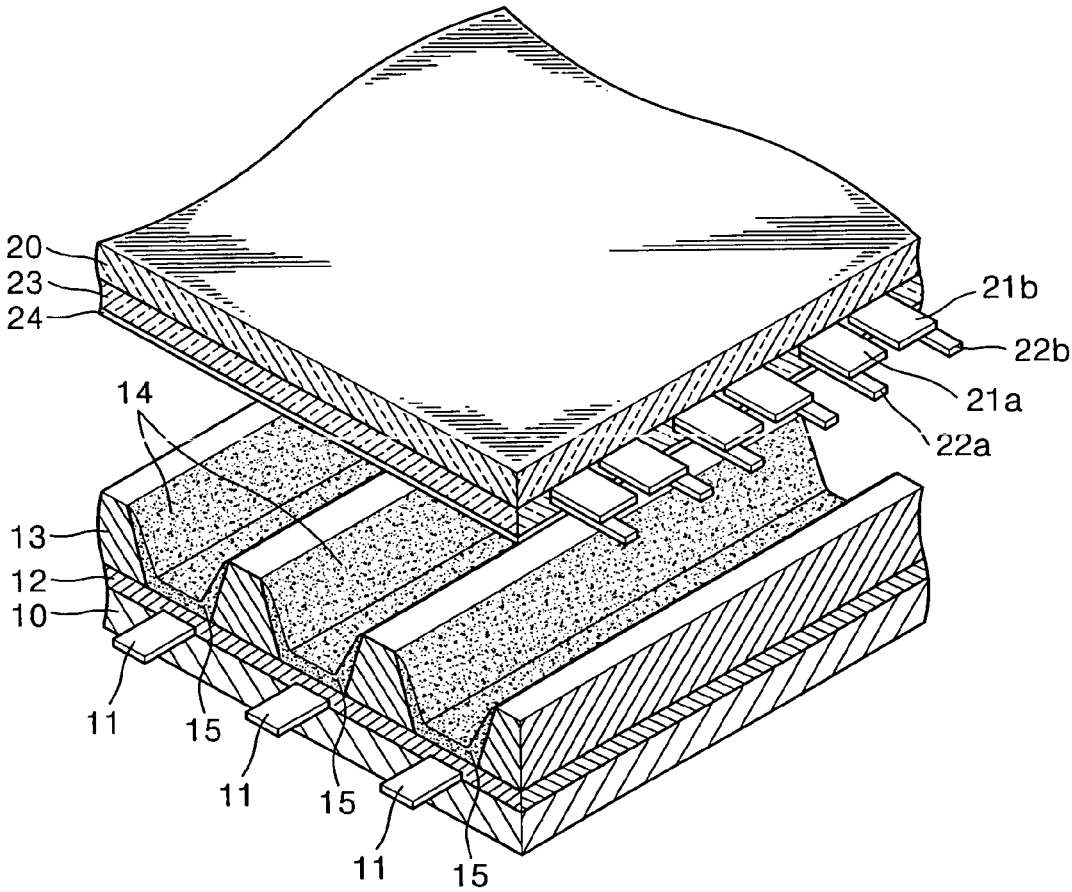
FIG. 1 is a perspective view of a portion of an Alternating Current (AC) plasma display panel (PDP)
Figure 2:
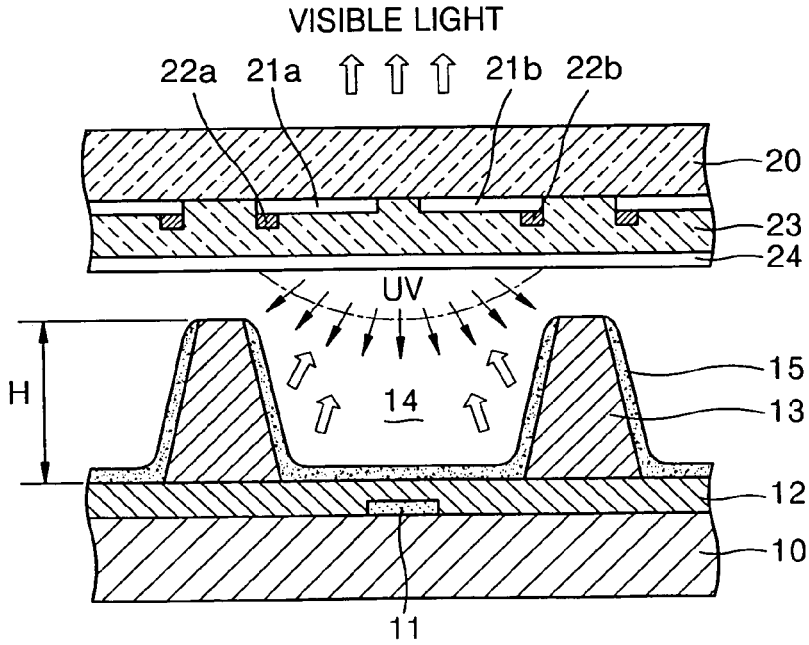
FIG. 2 is a vertical cross-section of the internal structure of the AC PDP of FIG. 1.

FIGS. 1 and 2 are views of an AC PDP. In FIG. 2, only a front substrate has been rotated 90° for better understanding of the internal structure of an AC PDP.

Referring to FIGS. 1 and 2, an AC PDP includes a rear substrate 10 and a front substrate 20 that face each other.

A plurality of address electrodes 1 1 are arranged in strips on the upper surface of the rear substrate 10 and buried in a first dielectric layer 12, which is white. A plurality of barrier ribs 13 for preventing electrical and optical interference between discharge cells 14 are formed on the upper surface of the first dielectric layer 12. Red (R), green (G), and blue (B) fluorescent layers 15 are respectively formed to a predetermined thickness on the inner surfaces of the discharge cells 14, which are defined by the barrier ribs 13. A discharge gas, for example, Ne, Xe, or a mixture of Ne and Xe, is injected into the discharge cells 14.

The front substrate 20 is transparent enough to transmit visible rays, is usually made of glass, and is combined with the rear substrate 10 having the barrier ribs 13. Pairs of sustaining electrodes 21 a and 21*b* are formed in strips on the bottom surface of the front substrate 20 so that they cross the address electrodes 11 at right angles. The sustaining electrodes 21*a* and 21*b* are usually formed of a transparent conductive material, such as indium tin oxide (ITO), so that they can transmit visible light. To reduce line resistance of the sustaining electrodes 21*a* and 21*b*, bus electrodes 22*a* and 22*b* made of metal are formed on the bottom surfaces of the sustaining electrodes 21*a* and 21*b*, respectively, such as to be narrower than the sustaining electrodes 21*a* and 21*b*. The sustaining electrodes 21*a* and 21*b* and the bus electrodes 22*a* and 22*b* are buried in a second dielectric layer 23, which is transparent. The bottom surface of the second dielectric layer 23 is covered with a protective layer 24, which prevents damage of the second dielectric layer 23 due to sputtering of plasma particles and emits secondary electrons to lower a discharge voltage and a sustain voltage. The protective layer 24 is usually formed of magnesium monoxide (MgO).

The timing for driving a 1 plasma display panel having such a structure can be divided into a reset period, an address period, and a sustaining period. During the reset period, the charge state of each of the discharge cells 14 is reset so that the discharge cells 14 are easily addressed. During the address period, address discharge occurs between an address electrode 11 and one sustaining electrode 21*b*, that is, a Y electrode, in a selected discharge cell 14. At this time, wall charges are accumulated in the selected discharge cell 14. During the sustaining period, sustaining discharge occurs between the Y electrode 21*b* and the other sustaining electrode 21*a*, that is, an X electrode, in the selected discharge cell 14 where wall charges are formed. During the sustaining discharge, the fluorescent layer 15 of the selected discharge cell 14 is excited by ultraviolet rays generated by a discharge gas and emits visible light. The visible light is emitted through the front substrate 20 to form an image that a user can recognize.

In the above-described PDP, the height (H) of each of the barrier ribs 13 greatly affects the luminous efficiency. In other words, as the height (H) of each of the barrier ribs 13 increases, the discharge space in each of the discharge cells 14 is enlarged to thus increase the luminous efficiency. On the other hand, as the height (H) of each of the barrier ribs 13 decreases, the interval between a pair of the sustaining electrodes 21*a* and 21*b* and an address electrode 11 is narrowed. Accordingly, an electrical field of the address electrode 11 interferes with sustaining a discharge occurring between the sustaining electrodes 21*a* and 21*b*, and charged particles, such as electrons or ions, are easily absorbed into the barrier ribs 13 to thus lower the luminous efficiency. As described above, in a PDP, as the height (H) of each of the barrier ribs 13 increases, the luminous efficiency increases.

However, if the height (H) of each of the barrier ribs 13 is equal to or greater than 180 μm, a shadow effect and resonance trapping occur due to an increase in the depth of the discharge cell 14, and a portion of the fluorescent layer 15 in contact with the first dielectric layer 12 becomes thinner. Thus, the luminous efficiency is lowered.

Hence, it is preferable that the height (H) of each of the barrier ribs 13 is as high as possible within the limit of 180 μm.

Also, as the height (H) of each of the barrier ribs 13 increases, the interval between each of the address electrode 11 and a pair of sustaining electrodes 21*a* and 21*b* increases, so that an address voltage increases. Hence, an excessive load is applied to a driver IC of the PDP, thus impeding a stable operation of the PDP. More specifically, if the height (H) of each of the barrier ribs 13 increases by 10 μm, the address voltage increases about 5V, the address discharge delay time increases about 7%, and the margin of the address voltage slightly decreases.

Considering the aforementioned problems, the height (H) of each of the barrier ribs 13 of the PDP is typically set to about 120 μm, and cannot be further higher.

An Alternating Current (AC) plasma display panel (PDP) according to an embodiment of the present invention will now be described more fully with reference to the accompanying drawings, in which exemplary embodiments of the present invention are shown. In the drawings, like reference symbols indicate the same or similar components.

Figure 3:
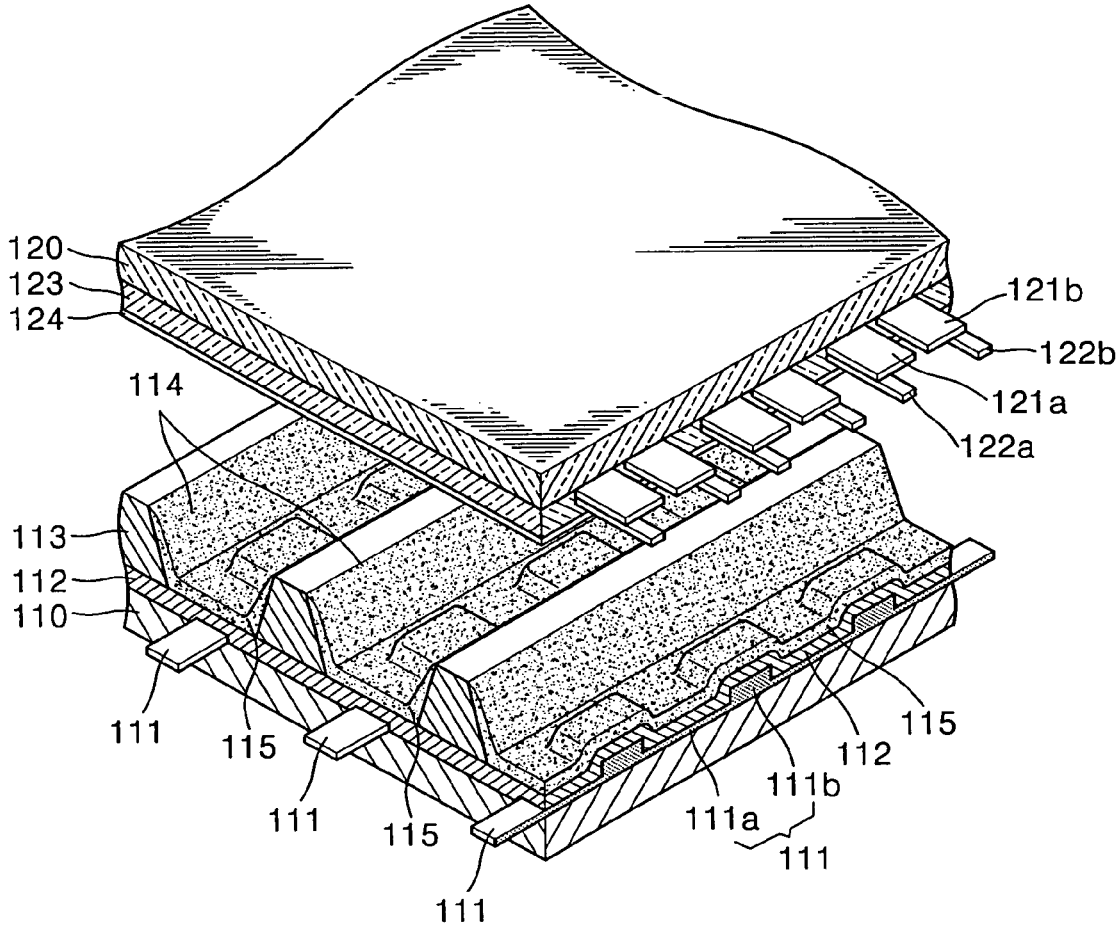
FIG. 3 is a perspective view of a portion of an AC PDP according to an embodiment of the present invention.
Figure 4:
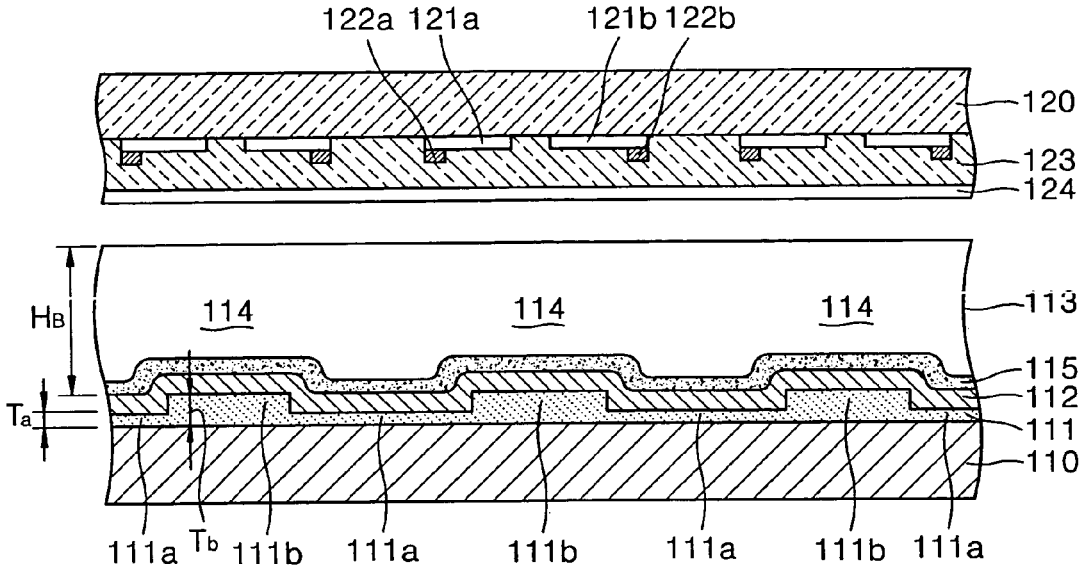
FIGS. 4 and 5 are vertical cross-sections of the portion of the AC PDP of FIG. 3.
Figure 5:
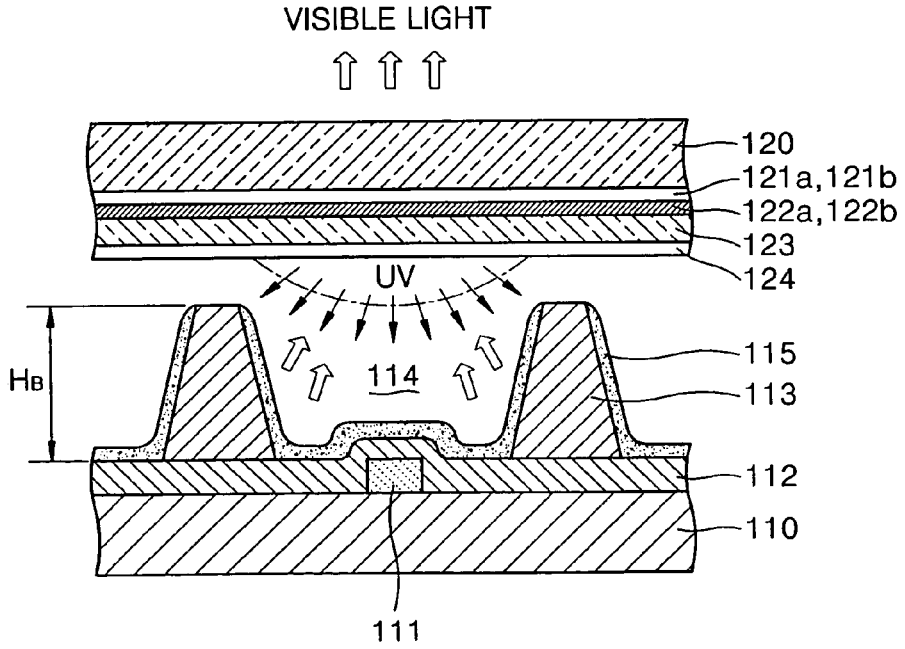
Figure 6:
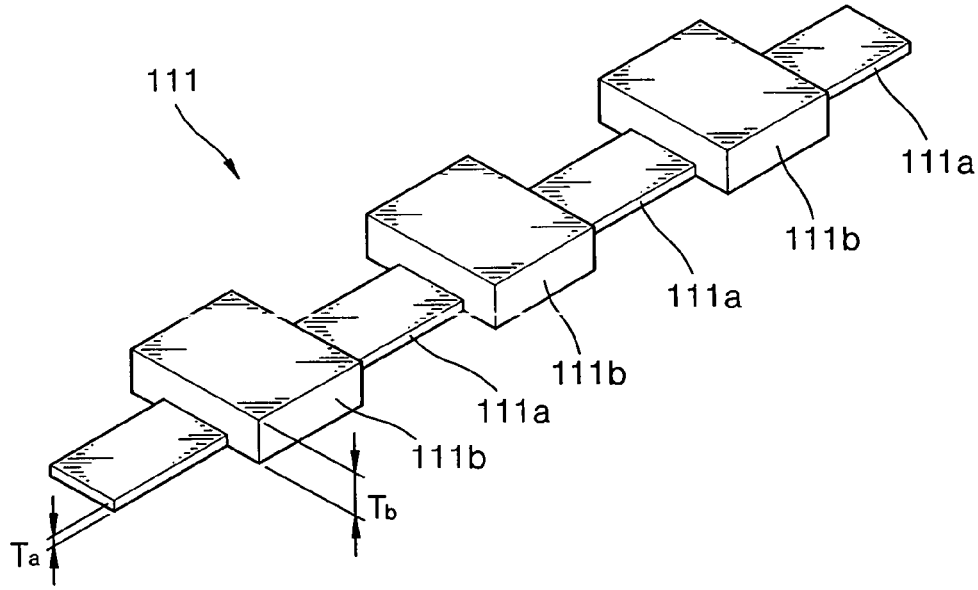
FIG. 6 is a perspective view of the address electrodes of FIG. 3.

FIGS. 3, 4, and 5 are respectively a perspective view of and vertical cross-sections of an AC PDP according to an embodiment of the present invention. FIG. 6 is a perspective view of the address electrodes of FIG. 3.

Referring to FIGS. 3 through 6, an AC PDP according to an embodiment of the present invention includes a rear substrate 110 and a front substrate 120, which are disposed so as to face each other. The rear and front substrates 110 and 120 are separated from each other by a predetermined interval and have a plurality of discharge cells 114 arranged therebetween.

The rear substrate 110 may be formed of glass. A plurality of address electrodes 111 are formed in strips on the upper surface of the rear substrate 110. The address electrodes 111 may be formed of a metallic material having a high conductivity and a low resistivity, for example, Ag, Al, or Cu. Each of the address electrodes 111 has thin portions 111*a* and thick portions 111*b*, which will be described in detail later.

The address electrodes 111 are buried in a first dielectric layer 112 formed on the upper surface of the rear substrate 110. The first dielectric layer 112 is formed of a white dielectric material so as to reflect visible light radiated from discharge cells 114.

A plurality of barrier ribs 113 are formed on the upper surface of the first dielectric layer 112 so as to define the discharge cells 114 to prevent occurrence of electrical and optical interference between adjacent discharge cells 114. A discharge gas, for example, Ne, Xe, or a mixture of Ne and Xe, is injected into the discharge cells 114 defined by the barrier ribs 113. A red (R), green (G), or blue (B) fluorescent layer 115 is formed to a predetermined thickness on opposite sides of adjacent barrier ribs 113 and a portion of the upper surface of the first dielectric layer 112 between the barrier ribs 113.

The front substrate 120 is transparent enough to transmit visible rays and is usually made of glass. Pairs of sustaining electrodes 121*a* and 121*b* are formed in strips on the bottom surface of the front substrate 120 so that they cross the address electrodes 111 at right angles. The sustaining electrodes 121*a* and 121*b* are formed of a transparent conductive material, such as, Indium Tin Oxide (ITO), so that they can transmit visible light radiated from the discharge cells 114. Because ITO has a relatively high resistance, the sustaining electrodes 12*a* and 121*b* have high line resistance. To reduce the high line resistance of the sustaining electrodes 121*a* and 121*b*, bus electrodes 122*a* and 122*b* made of a metal material with excellent conductivity are formed on the bottom surfaces of the sustaining electrodes 121*a* and 121*b*, respectively, in such a way that each of them is formed on one edge of the bottom surface of each of the sustaining electrodes 121*a* and 121*b*. The bus electrodes 122*a* and 122*b* are narrower than the sustaining electrodes 121*a* and 121*b*.

The sustaining electrodes 121*a* and 121*b* and the bus electrodes 122*a* and 122*b* are buried in a second dielectric layer 123 formed on the bottom surface of the front substrate 120. The second dielectric layer 123 is formed of a transparent dielectric material that can transmit the visible light. The bottom surface of the second dielectric layer 123 is covered with a protective layer 124, which prevents damage of the second dielectric layer 123 and the sustaining electrodes 121*a* and 121*b* due to sputtering of plasma particles and emits secondary electrons to lower a discharge voltage and a sustain voltage. The protective layer 124 may be formed of Magnesium Monoxide (MgO).

The height ($H_B$) of each of the barrier ribs 113 in the present invention is greater than the height of each of the barrier ribs of a standard PDP. To be more specific, the height ($H_B$) of each of the barrier ribs 113 can be set to be about 10μm–40 μm greater than that of an earlier PDP, that is, to be about 130 to 160 μm. Preferably, the height ($H_B$) of each of the barrier ribs 113 is set to be about 140 μm , which is about 20 μm greater than that of an earlier PDP. As described above, as the height of each of the barrier ribs 113 increases, the luminous efficiency is improved, and a sustain voltage is lowered. This will be described later with reference to the graphs of FIGS. 8, 9, and 10.

As described above, each of the address electrodes 111 includes a plurality of thin portions 111*a* and a plurality of thick portions 111*b*. The thick portions 111*b* are arranged at locations that correspond to the discharge cells 114. In other words, the thick portions 111*b* are arranged at a predetermined interval in such a way that one thick portion 111*b* is disposed under a pair of sustaining electrodes 121*a* and 121*b*. Each of the thin portions 111*a* is disposed between adjacent thick portions 111*b*. Accordingly, the address electrodes 111 are formed by alternately arranging the thin portions 111*a* and the thick portions 111*b*.

The thin portions 111*a* can be formed to the same thickness as that of an earlier PDP, for example, to a thickness of about 5 μm to 7 μm. However, the thick portions 111*b* are preferably about 10 to 30 μm thicker than the thickness ($T_a$) of the thin portions 111*a*. The thickness ($T_b$) of each of the thick portions 111*b* is determined according to the height ($H_B$) of each of the barrier ribs 113. More specifically, as the height ($H_B$) of each of the barrier ribs 113 increases, the thick portions 111*b* become thicker. If the height ($H_B$) of each of the barrier ribs 113 is about 140 μm, which is 20 μm greater than that of an earlier PDP, the thickness ($T_b$) of each of the thick portions 111*b* is about 20 m greater than the thickness ($T_a$) of each of the thin portions 111*a*. Each of the thick portions 111*b* can be wider than each of the thin portions 111*a*.

As described above, if the thick portions 111*b* of the address electrodes 111 are thicker than the thin portions 111*a*, the interval between each of the pairs of sustaining electrodes 121*a* and 121*b* and each of the address electrodes 111 can keep a standard interval without being increased even though the height ($H_B$) of each of the barrier ribs 113 increases. Hence, even though the height ($H_B$) of each of the barrier ribs 113 is increased to improve the luminous efficiency, an address voltage is not increased compared to a standard address voltage, so that application of an excessive load to a driver IC of a PDP is prevented.

In the structure of the address electrodes 111 according to an embodiment of the present invention, the address discharge delay time is not increased from a standard time. This will be described later with reference to FIG. 11.

Also, because the discharge cells 114 are more accurately distinguished from each other by the address electrodes 111 having the thin portions 111*a* and the thick portions 111*b*, electrical and optical interference between adjacent discharge cells 114 can be more securely prevented.

Furthermore, as shown in FIGS. 4 and 5, the fluorescent layer 115 has curves due to the above-described structure of the address electrodes 111, and accordingly, the surface area of the fluorescent layer 115 increases. Thus, the luminance of a PDP is improved.

Figure 7:
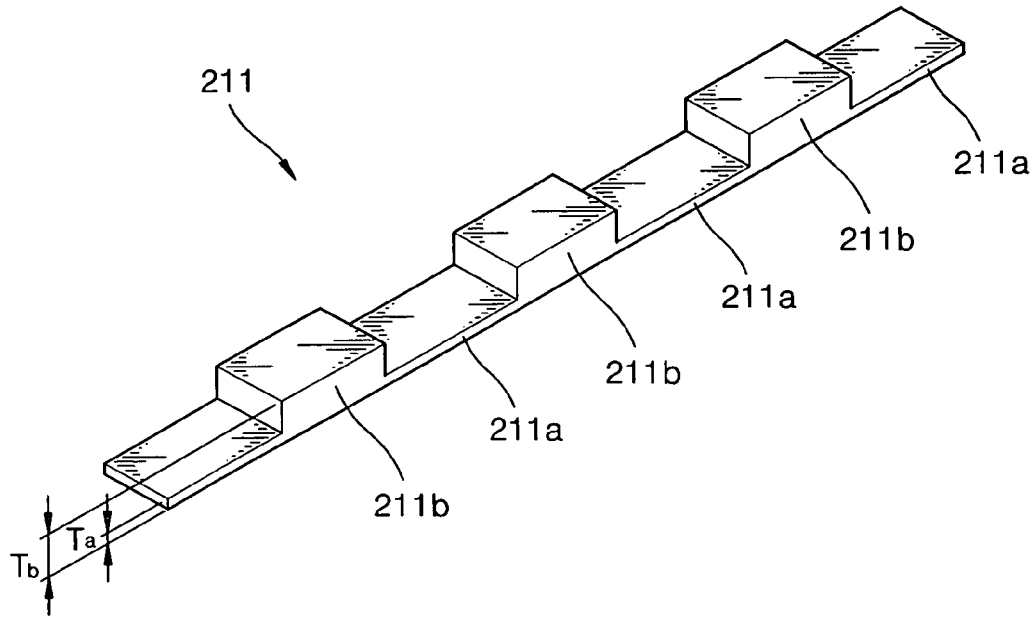
FIG. 7 is a perspective view of a modified example of the address electrodes of FIG. 3.

FIG. 7 is a perspective view of a modified example of the address electrodes 111 of FIG. 3. An address electrode 211 of FIG. 7 is formed by alternately arranging a plurality of thin portions 211*a* and a plurality of thick portions 211*b*. The thicknesses ($T_a$) and ($T_b$) of the thin and thick portions 211*a* and 211*b* are equal to those of the thin and thick portions 111*a* and 111*b*. However, in the address electrodes 211 of FIG. 7, each of the thick portions 211*b* has the same width as each of the thin portions 211*a*. The address electrode 211 having this structure can also obtain the same effects as described above.

FIGS. 8 through 12 are graphs extracted from a master's thesis of Seoul National University, entitled "Study on the Effect of Barrier Rib Height on the Discharge Characteristics of an AC PDP", written by Taejune Kim, announced on February, 2002. These graphs refer to experimental results with regard to an AC PDP and do not specifically refer to an AC PDP in accordance with the present invention.

Figure 8:
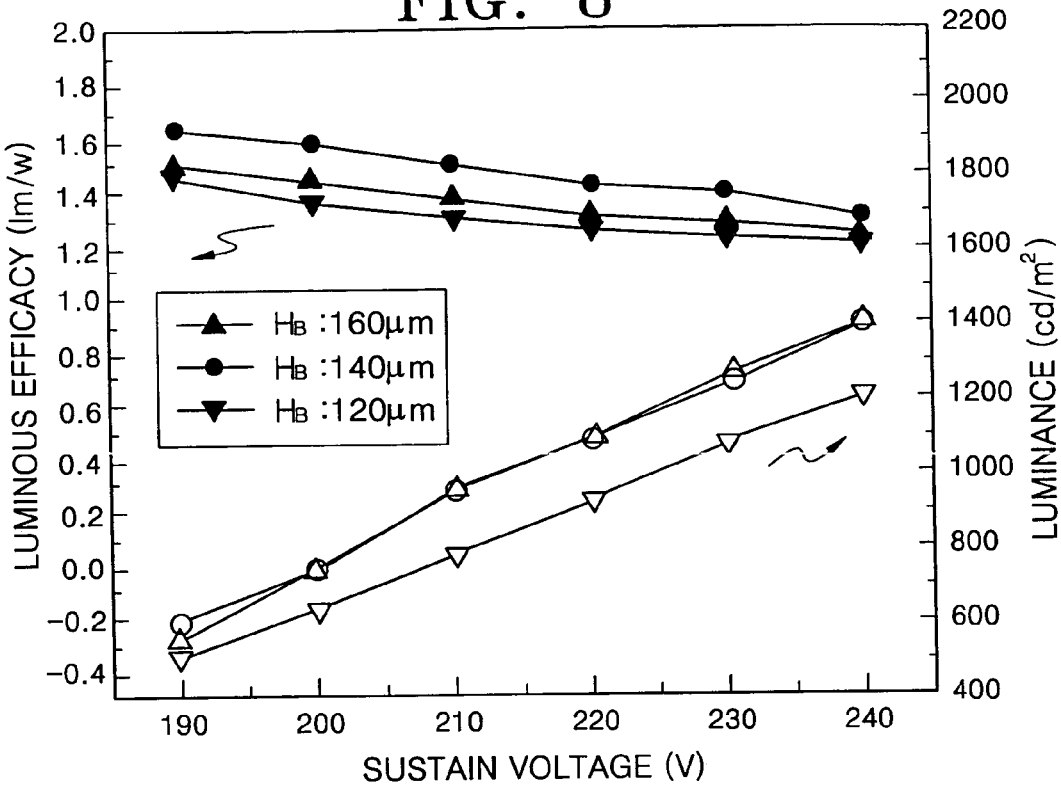
FIG. 8 is a graph of the luminous efficiency and luminance at different heights of a barrier rib versus a sustain voltage.
Figure 9:
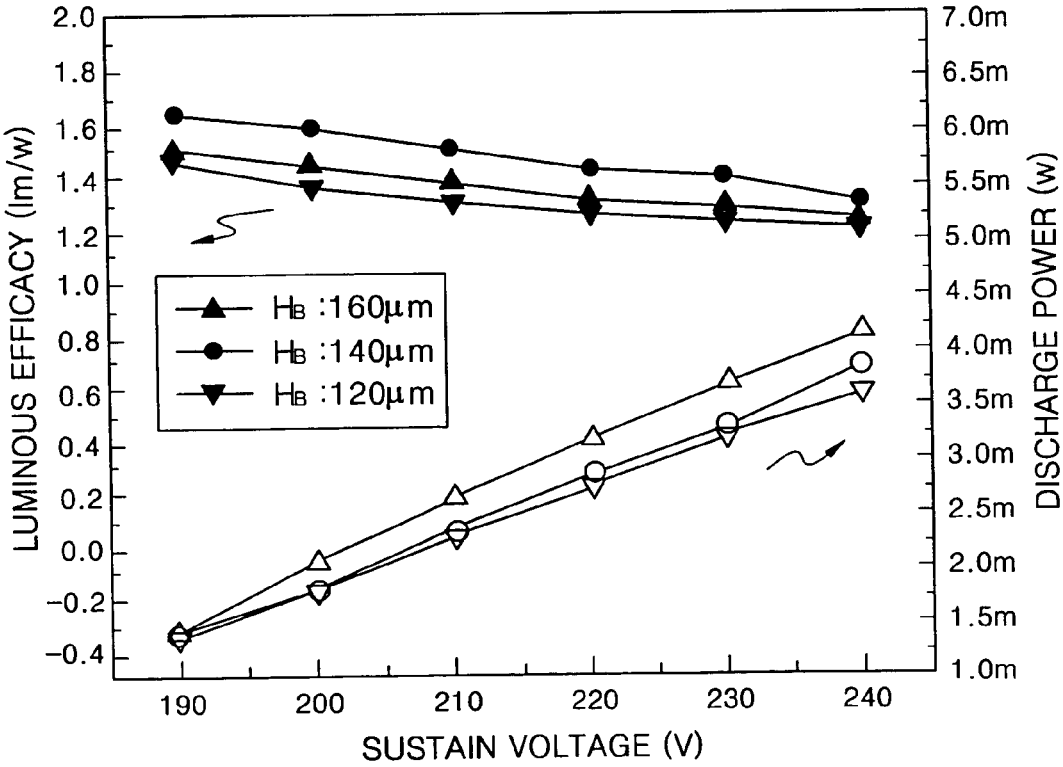
FIG. 9 is a graph of the luminous efficiency and discharge power at different heights of a barrier rib versus a sustain voltage.

FIG. 8 is a graph showing luminous efficiency and luminance at different heights of a barrier rib versus a sustain voltage. FIG. 9 is a graph showing luminous efficiency and discharge power at different heights of a barrier rib versus a sustain voltage. The graphs of FIGS. 8 and 9 show the luminous efficiency, luminance, and discharge power versus the height of a barrier rib and a sustain voltage when a reset voltage is 340V and an address voltage is 60V.

Referring to the graph of FIG. 8, the luminous efficiency is higher when the height ($H_B$) of a barrier rib is 140 μm or 160 μm than when the height ($H_B$) of a barrier rib is 120 μm. Particularly, when the height ($H_B$) of a barrier rib is 140 μm, the luminous efficiency is the greatest. Also, the luminance is higher when the height ($H_B$) of a barrier rib is 140 μm or 160 μm than when the height ($H_B$) of a barrier rib is 120 μm.

Referring to the graph of FIG. 9, discharge power increases as the height ($H_B$) of a barrier rib increases, yet the luminous efficiency is the highest when the height ($H_B$) of a barrier rib is 140 μm.

Hence, when a barrier rib according to the present invention is formed to be higher than a standard barrier rib, preferably, about 140 μm, a highly efficient PDP with high luminance can be obtained.

Figure 10:
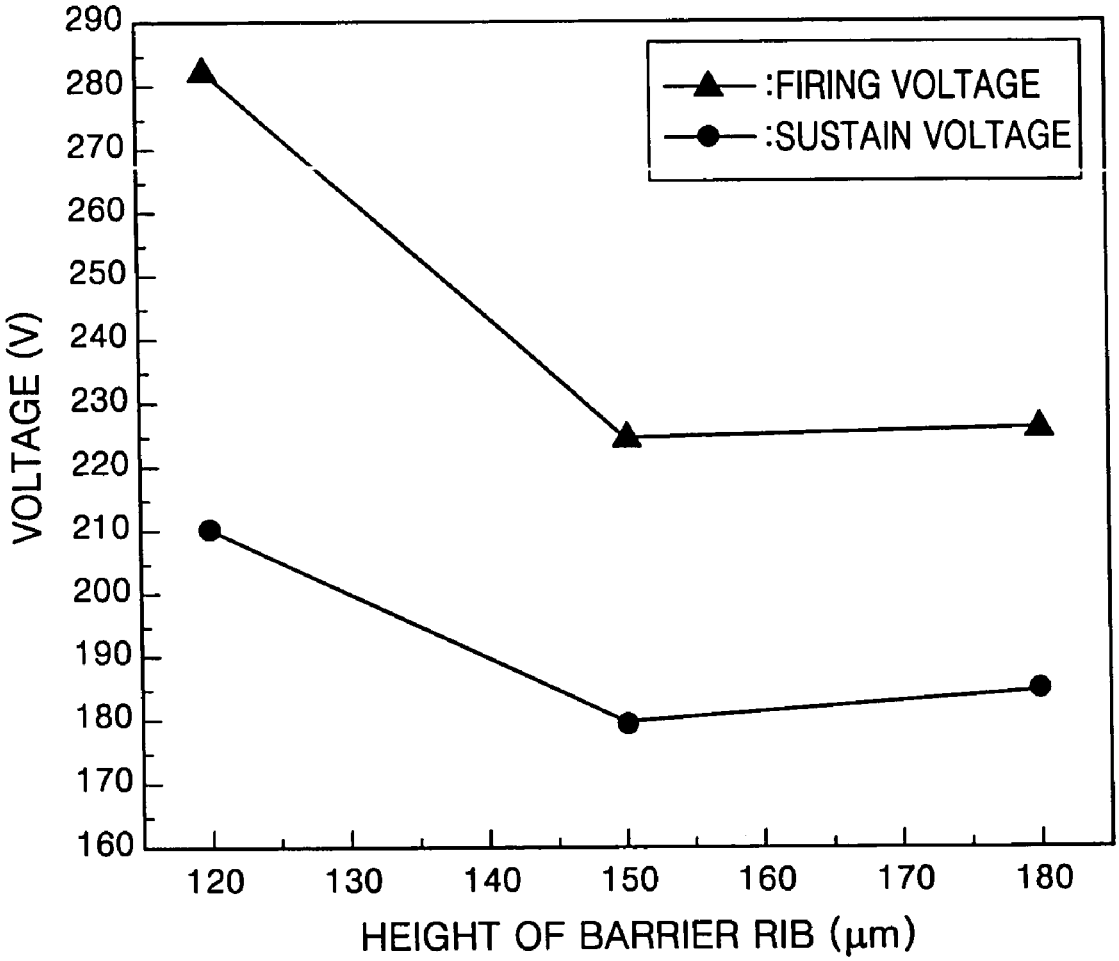
FIG. 10 is a graph of a sustain voltage and a firing voltage versus the height of a barrier rib.

FIG. 10 is a graph showing a sustain voltage and a firing voltage versus the height of a barrier rib when a reset voltage and an address voltage are 340V and 60V, respectively. Referring to the graph of FIG. 10, when the firing voltage and the sustain voltage are lower when the height ($H_B$) of a barrier rib is 150 μm or 180 μm than when the height ($H_B$) of a barrier rib is 120 μm. The reason why the firing voltage and the sustain voltage decrease with an increase in the height ($H_B$) of a barrier rib is that discharge spaces within discharge cells become larger with the increase in the height ($H_B$) of a barrier rib, so that the interference of an electrical field of address electrodes with sustaining discharge is reduced and the number of charged particles, such as electrons or ions, absorbed into barrier ribs is reduced.

Hence, in the present invention, if the height ($H_B$) of a barrier rib is set to be greater than that of a standard PDP, a sustain discharge can occur even with a voltage lower than that in a standard PDP. Accordingly, the load applied to the driver IC is reduced, contributing to a more stable operation of a PDP.

Figure 11:
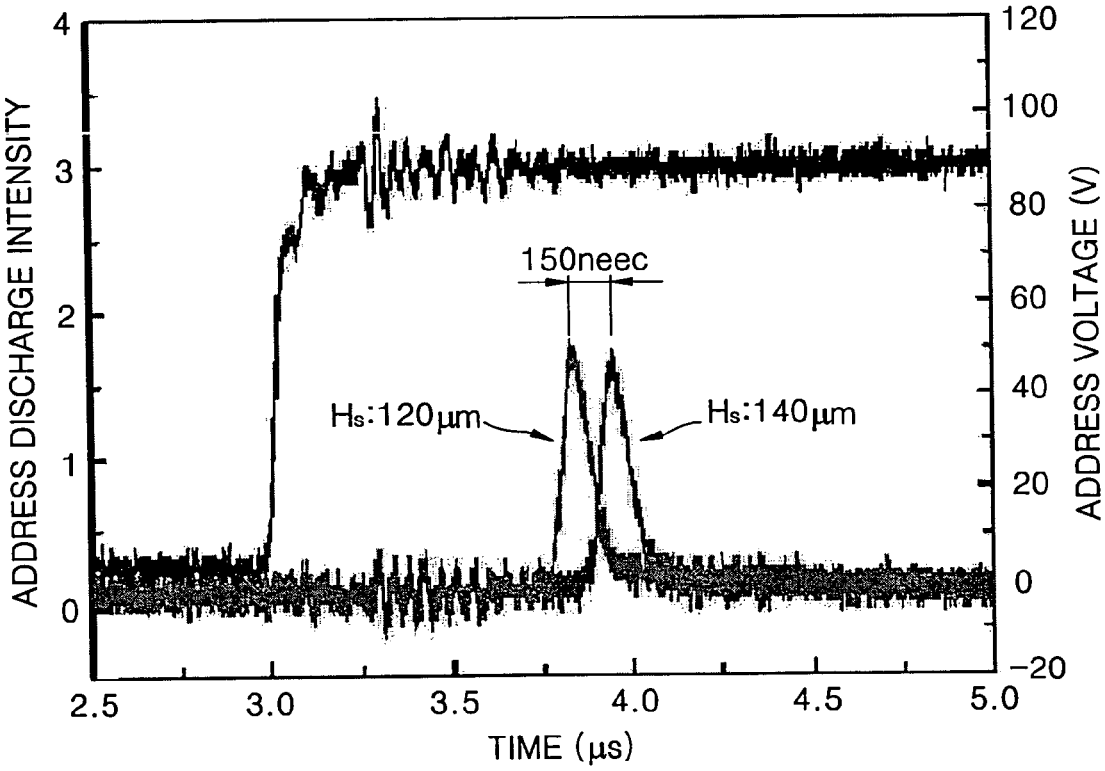
FIG. 11 is a graph of a variation of the address discharge delay time when the height of a barrier rib changes.

FIG. 11 is a graph of a variation of the time required to delay address discharge when the height of a barrier rib changes. Referring to FIG. 11, when the height ($H_B$) of a barrier rib increases from 120 μm to 140 μm, the address discharge delay time usually increases about 150 nsec. However, in the present invention, since address electrodes include thick portions, the intervals between the address electrodes and sustain electrodes are not increased even though the height ($H_B$) of a barrier rib increases from 120 μm to 140 μm. Thus, the address discharge delay time is not increased.

Therefore, in a PDP according to the present invention, even though the height ($H_B$) of a barrier rib increases to 140 μm, the address discharge delay time is the same as when the height ($H_B$) of a barrier rib increases to 120 μm. As a result, fast addressing can be achieved.

Figure 12:
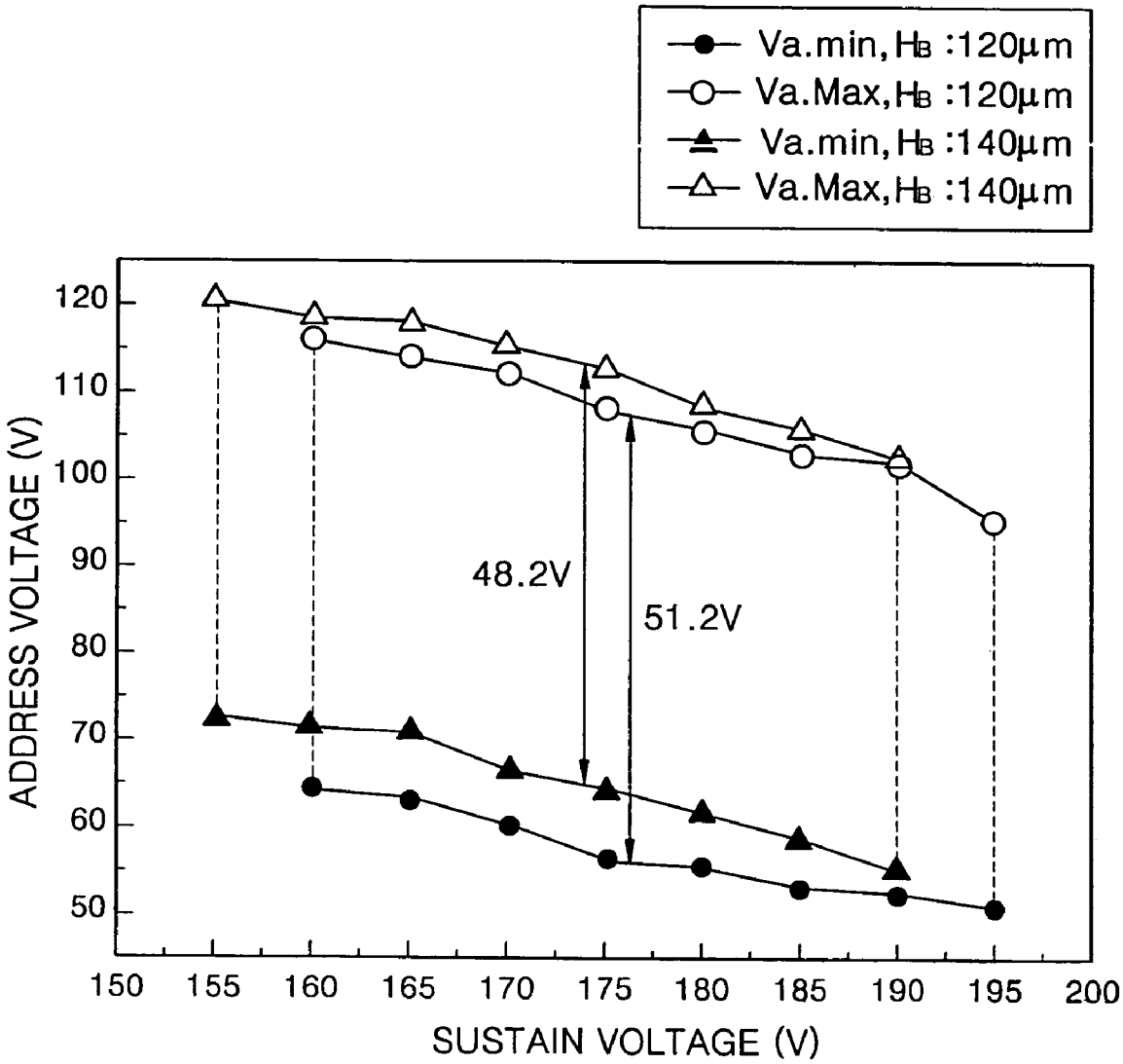
FIG. 12 is a graph of a variation of a margin of an address voltage when the height of a barrier rib changes.

FIG. 12 is a graph of a variation of a margin of an address voltage when the height of a barrier rib changes. Referring to FIG. 12, when the height ($H_B$) of a barrier rib increases from 120 μm to 140 μm, the margin of an address voltage (Va) generally decreases from about 51.2V to about 48.2V, that is, by about 3V. The margin of the address voltage Va denotes the difference between maximum and minimum values of the address voltage Va that enable address discharge to occur in only a desired discharge cell without affecting adjacent discharge cells. When the margin of the address voltage Va decreases, more precise control is required to selectively turn on the discharge cells, which is not preferable. However, in the present invention, since the address electrodes include thick portions, the intervals between the address electrodes and sustain electrodes are not increased even though the height ($H_B$) of a barrier rib increases from 120 μm to 140 μm. Thus, the margin of the address voltage Va does not decrease.

Particularly, in the present invention, since discharge cells are more accurately distinguished from one another by the address electrodes having thin and thick portions, an influence of an address electrical field upon adjacent discharge cells is reduced, so that the margin of the address voltage Va may rather increase.

A method of forming the above-described address electrodes on a rear substrate of a PDP according to an embodiment of the present invention will now be described with reference to FIGS. 13A through 13G and FIGS. 14A and 14B. FIGS. 13A through 13G are cross-sectional views of the steps of a first method of forming address electrodes on a rear substrate. FIGS. 14A and 14B are perspective views of portions of first and second screen masks, respectively, used in the first method.

Figure 13A:
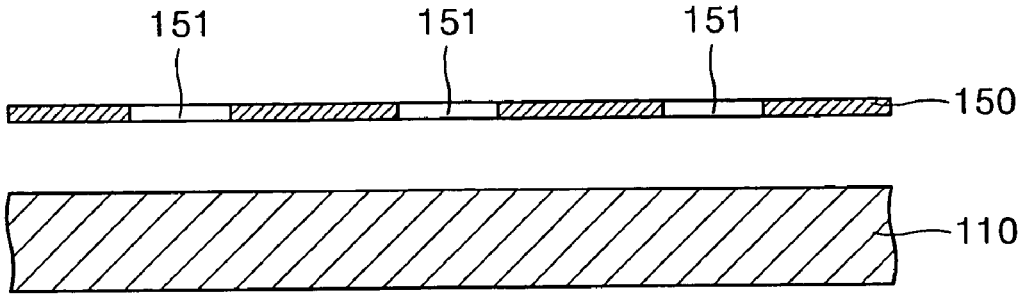
FIGS. 13A through 13G are cross-sectional views of the steps of a first method of forming address electrodes on a rear substrate.
Figure 14A:
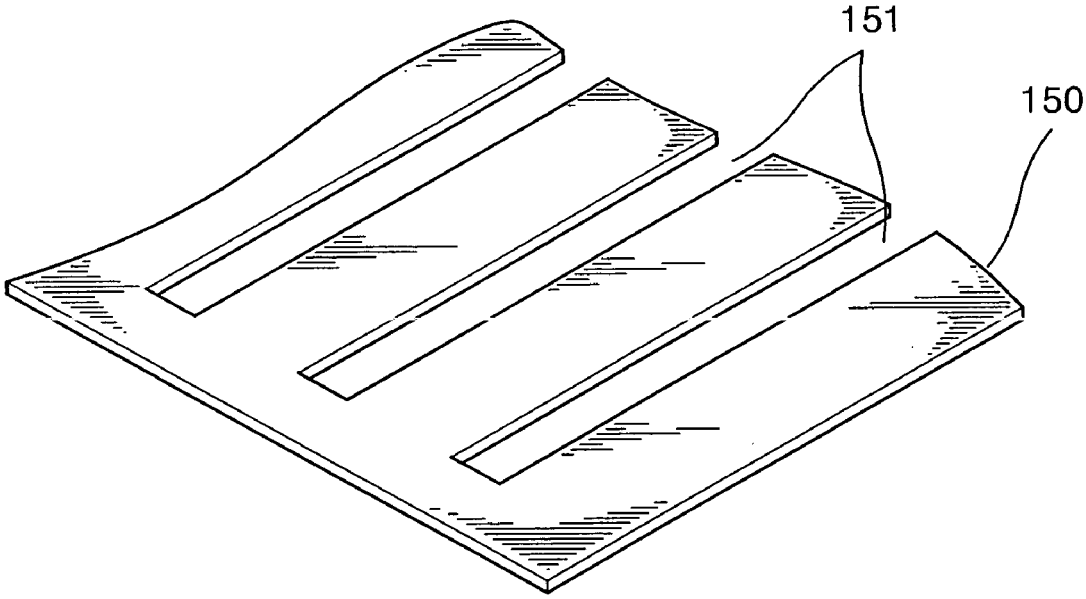
FIGS. 14A and 14B are perspective views of portions of the first and second screen masks, respectively, used in the first method.
Figure 14B:
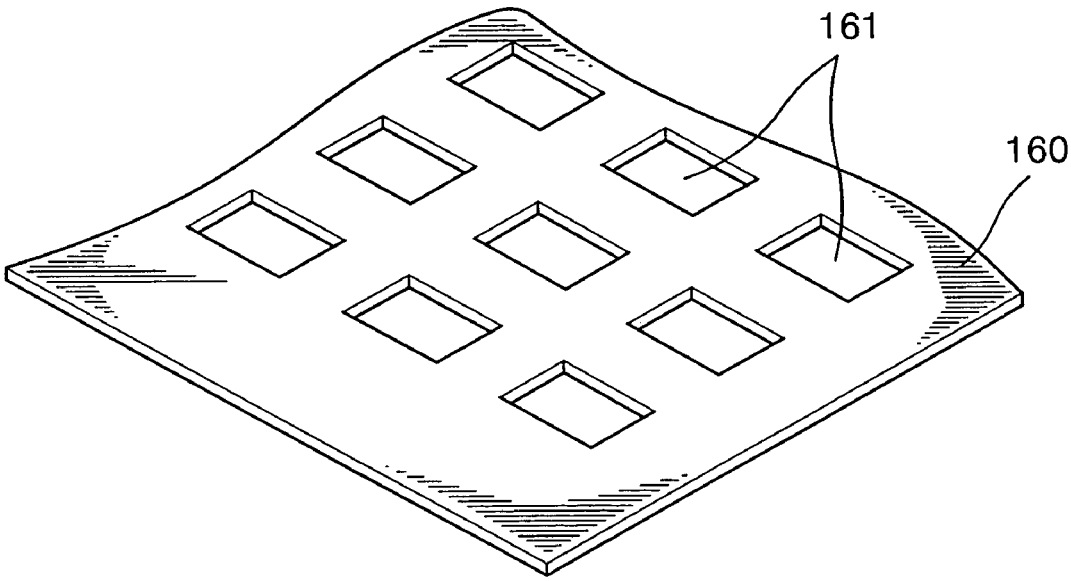

Referring to FIG. 13A, first, the rear substrate 110 is prepared. A glass substrate with a predetermined thickness can be used as the rear substrate 110. A first screen mask 150 is located over the rear substrate 110. As shown in FIG. 14A, the first screen mask 150 can be a stainless net on which openings 151 are formed in strips at a predetermined interval, for example, a #325 mesh stainless net. Here, the # number denotes the number of meshes included in a 1×1 inch square area. As the # number increases, the size of each mesh becomes smaller. On the other hand, as the # number decreases, the size of each mesh becomes larger.

Figure 13B:
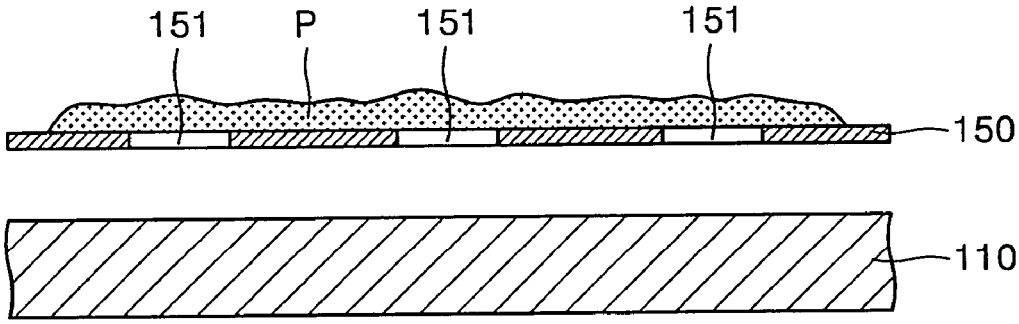

As shown in FIG. 13B, the upper surface of the first screen mask 150 is coated with a metal material with excellent conductivity, for example, Ag paste (P). Instead of Ag, Al or Cu can be used as the metal material.

Figure 13C:
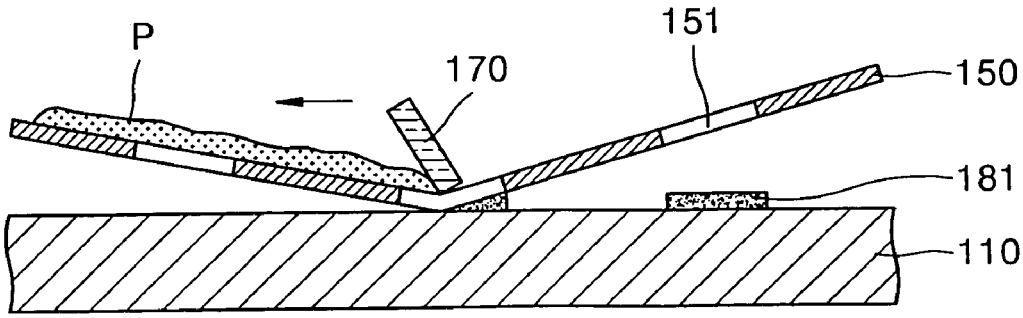
Figure 13D:
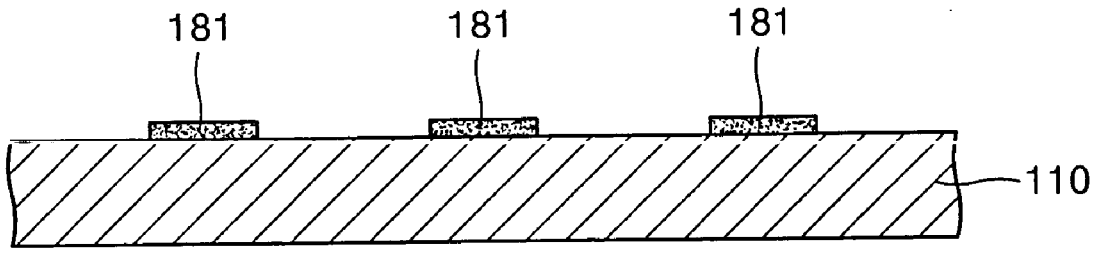

As shown in FIG. 13C, a pressure 170 moves in one direction while pressing the first screen mask 150 down on the rear substrate 110, thereby squeezing the Ag paste (P) on the rear substrate 110. Then, the Ag paste (P) slipped through the openings 151 of the first screen mask 150 is printed to a predetermined thickness on the upper surface of the rear substrate 110. Hence, as shown in FIG. 13D, first metal layers 181 each having the predetermined thickness are each formed in the shape of a strip on the upper surface of the rear substrate 110.

The thickness of each of the first metal layers 181 can be controlled according to the mesh of the first screen mask 150. In other words, if the # number of the first screen mask 150 increases, the size of each mesh becomes smaller, so that the first metal layers 181 printed on the rear substrate 110 become thinner. On the other hand, if the # number of the first screen mask 150 decreases, the size of each mesh becomes larger, so that the first metal layers 181 printed on the rear substrate 110 become thicker. As described above, when a #325 mesh stainless net is used as the first screen mask 150, the thickness of each of the first metal layers 181 is about 10 μm.

Thereafter, the first metal layers 181 in a paste state are dried.

Figure 13E:
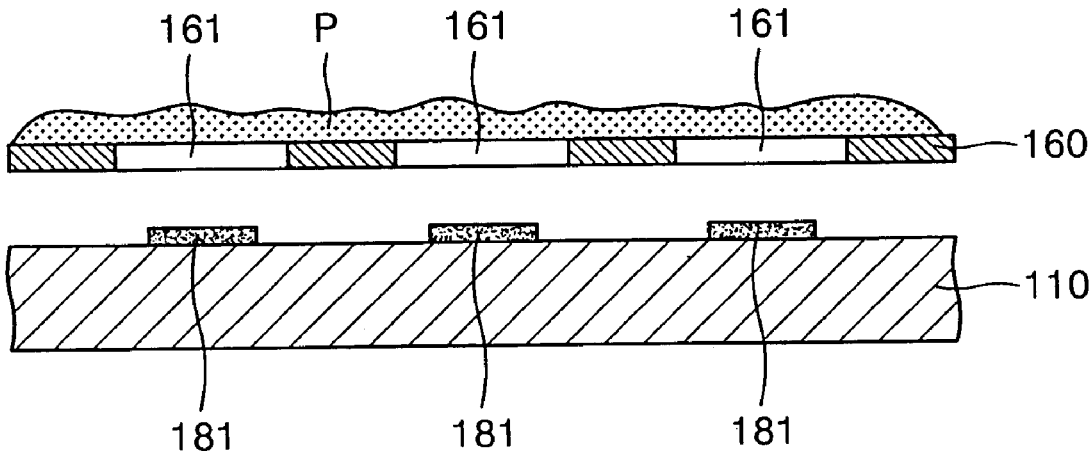

Next, as shown in FIG. 13E, a second screen mask 160 is located over the rear substrate 110 on which the first metal layers 181 have been formed. As shown in FIG. 14B, the second screen mask 160 can be a stainless net on which a plurality of rectangular openings 161 are formed, for example, a #80 to #100 mesh stainless net. The rectangular openings 161 are arranged at predetermined intervals along the first metal layers 181. The rectangular openings 161 may be wider than the first metal layers 181. Then, the upper surface of the second screen mask 160 is coated with Ag paste (P).

Figure 13F:
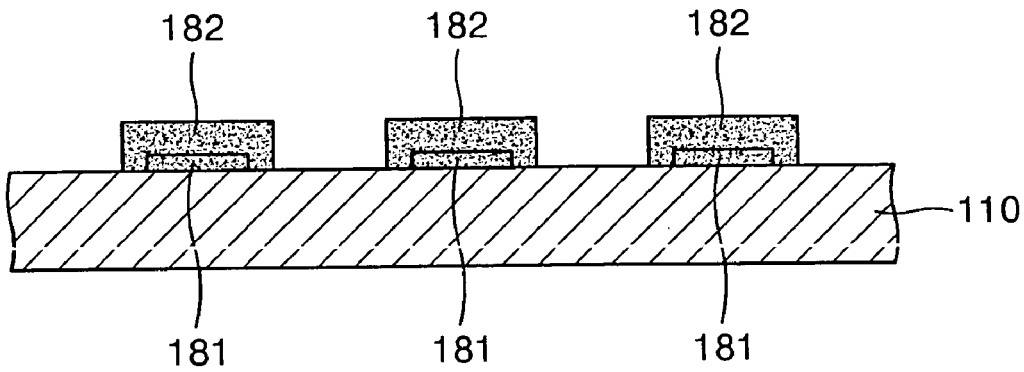

Referring to FIG. 13F, second metal layers 182 are formed to a predetermined thickness on the first metal layers 181. The second metal layers 182 can be formed in the same way as shown in FIG. 13C. The thickness of each of the second metal layers 182 can be controlled according to the mesh of the second screen mask 160. as described above, when the #80 mesh stainless net is used as the second screen mask 160, the thickness of each of the second metal layers 182 is about 40 μm.

Figure 13G:
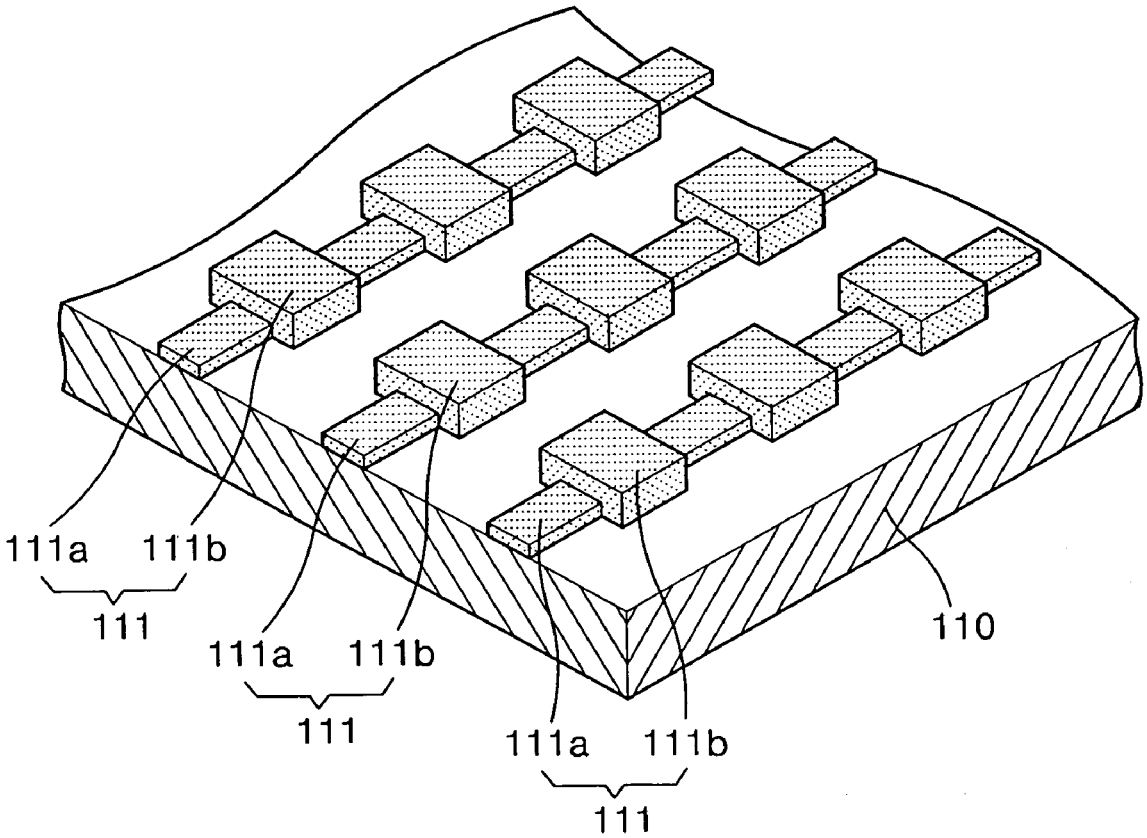

Thereafter, the second metal layers 182 in a paste state are dried, and the first and second metal layers 181 and 182 are plasticized. The plasticization reduces the thickness of each of the first metal layers 181 to about 5 to 7 μm and the thickness of each of the second metal layers 182 to about 20 μm. Then, as shown in FIG. 13G, the address electrodes 111 according to an embodiment of the present invention are formed on the rear substrate 110. To be more specific, portions constituted only by the first metal layers 181 form the thin portions 111*a* of an address electrode 111, and portions constituted by the overlapped first and second metal layers 181 and 182 form the thick portions 111*b* of the address electrode 111.

If each of the openings 161 of the second screen mask 160 has the same width as that of each of the openings 151 of the first screen mask 150, then the address electrode 211 of FIG. 7 having the thin and thick portions 211*a* and 211*b* with an identical width can be formed. As described above, as the # number of the first and second screen masks 150 and 160 change, the thickness of each of the first and second metal layers 181 and 182 printed on the rear substrate 10 changes. Accordingly, the thin and thick portions 111*a* and 111*b* of the address electrode 111 can be of various thicknesses.

Figure 15:
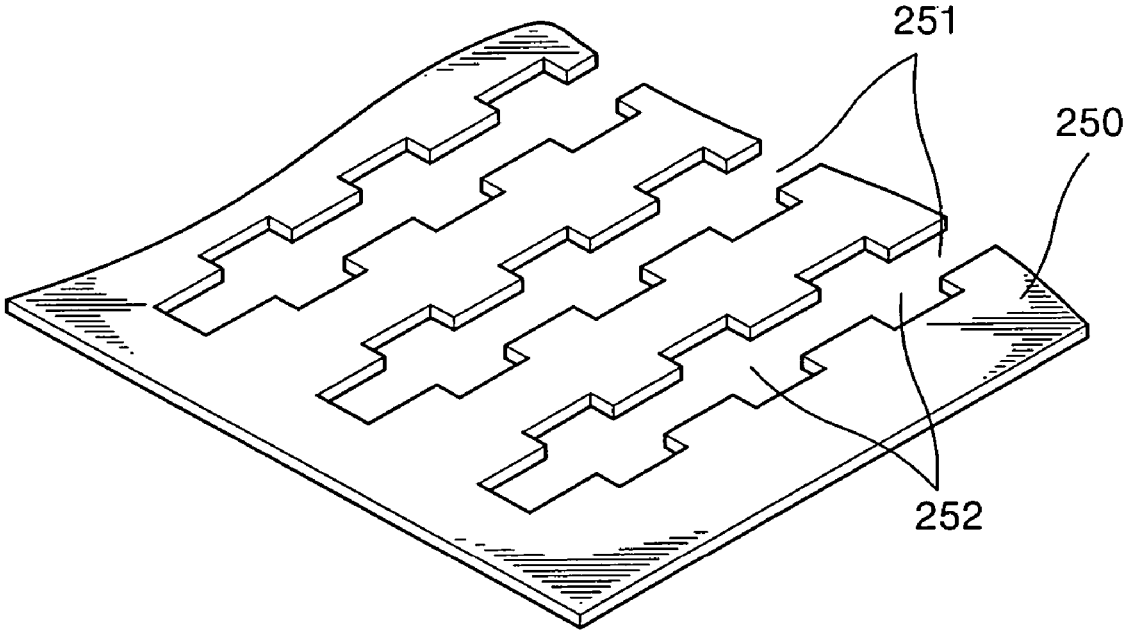
FIG. 15 is a perspective view of a portion of a screen mask used in a second method of forming address electrodes on a rear substrate.

FIG. 15 is a perspective view of a portion of a screen mask used in a second method of forming address electrodes on a rear substrate. Referring to FIG. 15, in the second method of forming address electrodes on a rear substrate, metal layers forming the thin and thick portions of the address electrodes are simultaneously printed on the rear substrate by using a single screen mask 250. To do this, the screen mask 250 includes first and second openings 251 and 252. The first openings 251 are narrower than the second openings 252, and the first and second openings 251 and 252 alternate with each other. To form the address electrode 211 of FIG. 7, the first and second openings 251 and 252 may have the same width. An area of the screen mask 250 where the first openings 251 are formed is made of a stainless net with a larger # number, for example, a #325 mesh, while an area of the screen mask 250 where the second openings 252 are formed is made of a stainless net with a smaller # number, for example, a #80 to #100 mesh. Hence, metal layers printed on a rear substrate using the first openings 251 each have a thickness of about 10 μm, and metal layers printed on a rear substrate using the second openings 252 each have a thickness of about 40 μm.

The second method of forming address electrodes according to an embodiment of the present invention is the same as the above-described first method except for the step of printing metal layers using a screen mask. In other words, when Ag paste (P) is printed on a rear substrate using the screen mask 250, dried, and then plasticized, an address electrode having thin and thick portions as shown in FIG. 6 or 7 is formed.

As described above, in a PDP according to an embodiment of the present invention, address electrodes are partially made thick so that the interval between the address electrodes and sustaining electrodes cannot be increased even when barrier ribs become higher. Thus, high luminous efficiency can be obtained without increases in an address voltage and the address discharge delay time.

When the barrier ribs become higher, sustain discharge can occur even with a sustain voltage lower than a sustain voltage used in a standard PDP. Thus, the load applied to a driver IC is reduced, contributing to a more stable operation of a PDP.

Also, since discharge cells are more precisely distinguished from one another by address electrodes having thin and thick portions, electrical and optical interference between adjacent discharge cells can be more securely prevented. Particularly, the influence of an address electrical field upon adjacent discharge cells is reduced, thus increasing the margin of an address voltage.

Furthermore, since a fluorescent layer has curves due to the structure of the address electrodes, its surface area increases, thus improving the luminance of a PDP.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a front substrate and a rear substrate arranged to face each other, the front and rear substrates having discharge cells arranged therebetween;

a plurality of strip-shaped address electrodes arranged on the rear substrate;

a first dielectric layer arranged on the rear substrate, the first dielectric layer having the plurality of strip-shaped address electrodes buried therein;

a plurality of strip-shaped sustaining electrodes arranged in pairs on the rear substrate to cross the plurality of strip-shaped address electrodes at right angles;

a second dielectric layer arranged on the rear substrate, the second dielectric layer having the plurality of strip-shaped sustaining electrodes buried therein;

a protective layer arranged on a bottom surface of the second dielectric layer; and a plurality of barrier ribs arranged between the front and rear substrates, the plurality of barrier ribs defining the discharge cells, and having lateral sides coated with a fluorescent layer;

wherein each of the plurality of strip-shaped address electrodes includes thick portions arranged below the discharge cells and thin portions arranged between adjacent thick portions; and wherein the thick portions of the plurality of strip-shaped address electrodes are thicker than the thin portions of the plurality of strip-shaped address electrodes.

2. The plasma display panel of claim 1, wherein each of the thick portions of the of the plurality of strip-shaped address electrodes has a thickness of between 5 to 7 μm.

3. The plasma display panel of claim 1, wherein the thick portions of the plurality of strip-shaped address electrodes are between 10 to 30 μm thicker than the thin portions of the plurality of strip-shaped address electrodes.

4. The plasma display panel of claim 3, wherein the thick portions of the plurality of strip-shaped address electrodes are 20 μm thicker than the thin portions of the plurality of strip-shaped address electrodes.

5. The plasma display panel of claim 3, wherein the height of each of the plurality of barrier ribs is in the range of 130 to 160 μm.

6. The plasma display panel of claim 5, wherein the height of each of the plurality of barrier ribs is 140 μm.

7. The plasma display panel of claim 1, wherein the thick portions of the plurality of strip-shaped address electrodes are wider than the thin portions of the plurality of strip-shaped address electrodes.

8. The plasma display panel of claim 1, wherein the widths of the thick portions of the plurality of strip-shaped address electrodes are the same as the widths of the thin portions of the plurality of strip-shaped address electrodes.

9. A plasma display panel comprising:

a front substrate and a rear substrate arranged to face each other, the front and rear substrates having discharge cells arranged therebetween;

a plurality of strip-shaped address electrodes arranged on the rear substrate;

a plurality of strip-shaped sustaining electrodes arranged in pairs on the rear substrate to cross the plurality of strip-shaped address electrodes at right angles; and a plurality of barrier ribs arranged between the front and rear substrates, the plurality of barrier ribs defining the discharge cells;

wherein each of the plurality of strip-shaped address electrodes includes thick portions arranged below the discharge cells and thin portions arranged between adjacent thick portions; and wherein the thick portions of the plurality of strip-shaped address electrodes are thicker than the thin portions of the plurality of strip-shaped address electrodes.

10. The plasma display panel of claim 9, wherein each of the thick portions of the of the plurality of strip-shaped address electrodes has a thickness of between 5 to 7 μm.

11. The plasma display panel of claim 9, wherein the thick portions of the plurality of strip-shaped address electrodes are between 10 to 30 μm thicker than the thin portions of the plurality of strip-shaped address electrodes.

12. The plasma display panel of claim 11, wherein the thick portions of the plurality of strip-shaped address electrodes are 20 μm thicker than the thin portions of the plurality of strip-shaped address electrodes.

13. The plasma display panel of claim 11, wherein the height of each of the plurality of barrier ribs is in the range of 130 to 160 μm.

14. The plasma display panel of claim 13, wherein the height of each of the plurality of barrier ribs is 140 μm.

15. The plasma display panel of claim 9, wherein the thick portions of the plurality of strip-shaped address electrodes are wider than the thin portions of the plurality of strip-shaped address electrodes.

16. The plasma display panel of claim 9, wherein the widths of the thick portions of the plurality of strip-shaped address electrodes are the same as the widths of the thin portions of the plurality of strip-shaped address electrodes.

* * * * *